US008279124B1

(12) United States Patent
Jones et al.

(10) Patent No.: US 8,279,124 B1
(45) Date of Patent: Oct. 2, 2012

(54) ANTENNA SYSTEM AND METHOD

(75) Inventors: Bryce A. Jones, Overland Park, KS (US); David N. Alberico, Overland Park, KS (US); Trevor Daniel Shipley, Olathe, KS (US); Cesar Perez, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 436 days.

(21) Appl. No.: 12/694,076

(22) Filed: Jan. 26, 2010

(51) Int. Cl.
*H01Q 1/32* (2006.01)

(52) U.S. Cl. ..... 343/713; 343/711; 343/727; 343/818

(58) Field of Classification Search ..... 343/711, 343/712, 713, 725, 727, 729, 739, 818
See application file for complete search history.

(56) References Cited

U.S. PATENT DOCUMENTS 4,220,955 A 9/1980 Frye
5,057,847 A 10/1991 Vaisanen
5,357,262 A 10/1994 Blaese
5,777,585 A 7/1998 Tsuda et al.
6,239,769 B1 5/2001 Ericsson et al.
8,164,527 B2 * 4/2012 Doneker et al. ..... 343/702
2006/0105701 A1 * 5/2006 Cornwell ..... 455/1
2008/0079388 A1 4/2008 Sarnowsky et al.
2010/0295752 A1 * 11/2010 Nibe ..... 343/904
2010/0309085 A1 * 12/2010 Pera et al. ..... 343/840

* cited by examiner

*Primary Examiner* — Hoanganh Le

(57) ABSTRACT

An antenna system comprises a mounting plate, a parabolic antenna, a yagi antenna, and a communication link interface. The parabolic antenna forms a cavity and comprises a vertex and a base, wherein the base is non-conductively connected to the mounting plate. The yagi antenna is non-conductively connected to the mounting plate within the cavity of the parabolic antenna, wherein the yagi antenna comprises a reflector element proximate to the mounting plate, a driven element, and a director element proximate to the vertex of the parabolic antenna. The communication link interface is configured to attach a communication link to an external antenna. The communication link interface is electrically coupled to the driven element and configured to receive electromagnetic energy from the director element.

20 Claims, 7 Drawing Sheets

ANTENNA SYSTEM AND METHOD

TECHNICAL BACKGROUND

Individuals and businesses are becoming progressively reliant on communication networks to send and receive information. For example, individuals may utilize communication networks for voice communications, research, and entertainment, and organizations typically require the use of high speed data networks such as the Internet for conducting critical business transactions. To access these communication services, people are frequently turning to wireless communication devices.

Due to the mobile nature of wireless communication devices, such devices enable the user to conduct voice calls and access information over a communication network from any location within range of a wireless signal from a communication service provider. As a result, people are increasingly utilizing wireless communication devices while traveling in automobiles. A user of a wireless communication device desires a strong wireless signal, clear voice transmissions, high speed data transfers, long battery life, and minimal dropped calls and transmission errors, regardless of whether the user is operating the device in a fixed terrestrial location or when traveling in a mobile vehicle. Factors that may affect the signal strength of the user's wireless communication device include the device's antenna gain, the line of sight of the device's antenna to a serving base station, and the amount of interference from radio frequency (RF) shielding that the wireless communication device may be exposed to in a given operating environment.

OVERVIEW

An antenna system comprises a mounting plate, a parabolic antenna, a yagi antenna, and a communication link interface. The parabolic antenna forms a cavity and comprises a vertex and a base, wherein the base is non-conductively connected to the mounting plate. The yagi antenna is non-conductively connected to the mounting plate within the cavity of the parabolic antenna, wherein the yagi antenna comprises a reflector element proximate to the mounting plate, a driven element, and a director element proximate to the vertex of the parabolic antenna. The communication link interface is configured to attach a communication link to an external antenna. The communication link interface is electrically coupled to the driven element and configured to receive electromagnetic energy from the director element.

A vehicle antenna system comprises a mounting plate, an external antenna, a parabolic antenna, a yagi antenna, a communication link interface, a communication link, and a wireless communication device cradle. The mounting plate is configured to attach to a vehicle. The external antenna is configured to attach to the vehicle. The parabolic antenna forms a cavity and comprises a vertex and a base, wherein the base is non-conductively connected to the mounting plate. The yagi antenna is non-conductively connected to the mounting plate within the cavity of the parabolic antenna, wherein the yagi antenna comprises a reflector element proximate to the mounting plate, a driven element, and a director element proximate to the vertex of the parabolic antenna. The communication link interface is configured to attach the communication link to the external antenna. The communication link interface is electrically coupled to the driven element and configured to receive electromagnetic energy from the director element. The communication link is configured to attach to the communication link interface and the external antenna.

A method of operating an antenna system comprises, in a parabolic antenna, receiving a transmit signal from a wireless communication device and wirelessly propagating the transmit signal to a yagi antenna, wherein the yagi antenna is positioned within a cavity formed by the parabolic antenna. The method further comprises, in the yagi antenna, receiving the transmit signal and wirelessly propagating the transmit signal toward a communication link interface. The method further comprises, in the communication link interface, receiving the transmit signal and transferring the transmit signal to a communication link coupled to an external antenna. The method further comprises, in the communication link interface, receiving a receive signal from the communication link coupled to the external antenna and transferring the receive signal to the yagi antenna. The method further comprises, in the yagi antenna, receiving the receive signal and wirelessly propagating the receive signal toward the parabolic antenna. The method further comprises, in the parabolic antenna, receiving the receive signal and wirelessly propagating the receive signal toward the wireless communication device.

DETAILED DESCRIPTION

The following description and associated drawings teach the best mode of the invention. For the purpose of teaching inventive principles, some conventional aspects of the best mode may be simplified or omitted. The following claims specify the scope of the invention. Some aspects of the best mode may not fall within the scope of the invention as specified by the claims. Thus, those skilled in the art will appreciate variations from the best mode that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
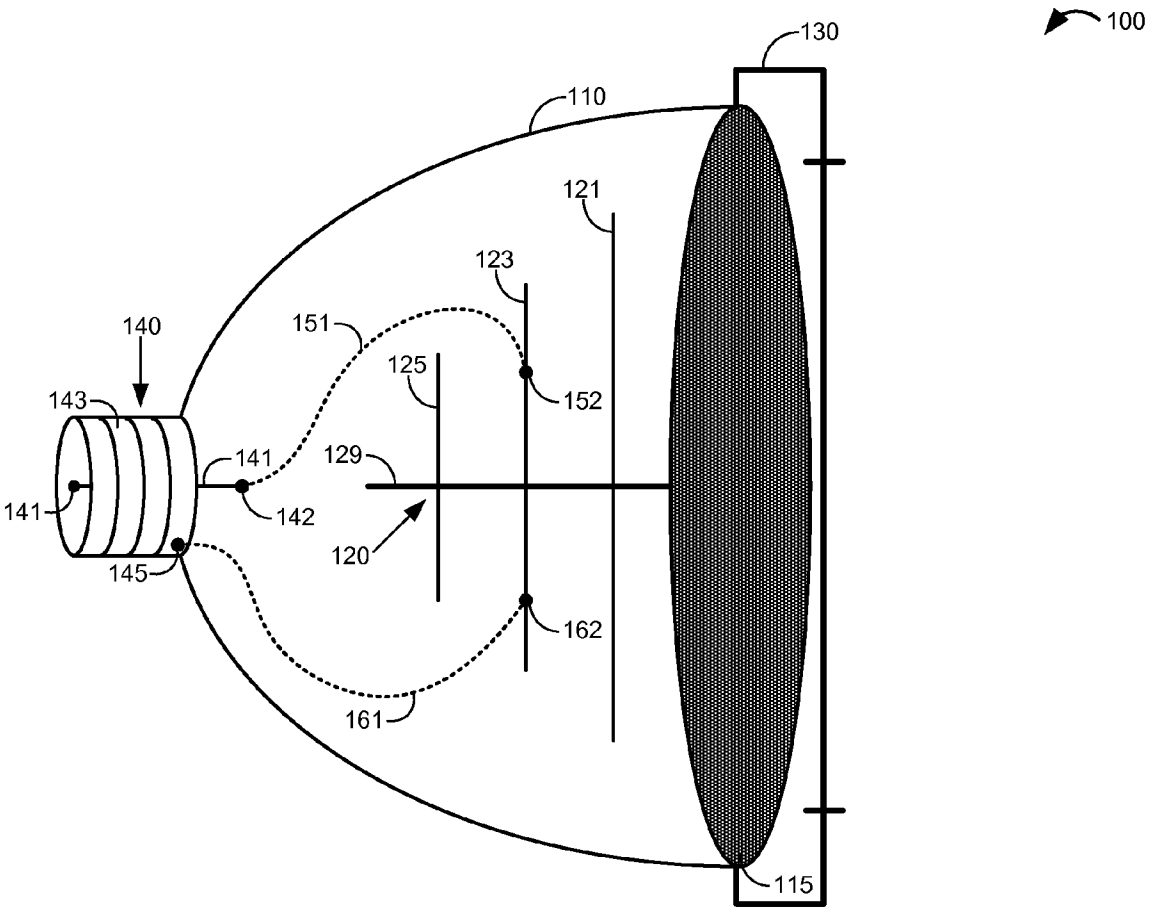
FIG. 1 is a schematic drawing of an antenna system.

FIG. 1 is a schematic drawing of antenna system 100. Antenna system 100 comprises parabolic antenna 110, yagi antenna 120, mounting plate 130, and communication link interface 140.

Parabolic antenna 110 comprises a vertex and a base 115 forming a cavity. In this example, communication link interface 140 is located at the vertex of parabolic antenna 110. Parabolic antenna 110 is shown in FIG. 1 with a transparent sidewall to allow for depiction of the yagi antenna 120 and internal connections within parabolic antenna 110, but parabolic antenna 110 would not typically be constructed of transparent materials. Instead, one example of parabolic antenna 110 typically comprises a hollow shell constructed of two layers: an interior layer comprising a conductive material and an exterior layer comprising a non-conductive material. For example, parabolic antenna 110 may be constructed of a metallic conductive material such as copper, silver, or gold proximate to the cavity formed by parabolic antenna 110, and a plastic, rubber, wood, or other non-conductive material encapsulating the inner metallic conductive material and forming the outer surface of parabolic antenna 110. Base 115 of parabolic antenna 110 is also constructed of a non-conductive material such as plastic, rubber, or wood. In some examples, parabolic antenna 110 comprises a three-dimensional elliptical paraboloid.

Yagi antenna 120 comprises reflector element 121, driven element 123, and director element 125. Driven element 123 is also commonly referred to as the active dipole element. Yagi antenna also comprises boom 129 which provides a support structure for yagi antenna 120. Elements 121, 123, and 125 are attached to boom 129. The construction of reflector element 121, driven element 123, and director element 125 comprises a conductive material, such as metal. Driven element 123 comprises an active segment and a ground segment. Boom 129 may comprise any rigid material including conductive and non-conductive materials; however, if boom 129 is constructed of conductive materials, the active and ground segments of driven element 123 are typically electrically shielded from one another by a non-conductive material. In other words, driven element 123 would typically be electrically isolated from boom 129 if boom 129 comprises a conductive material. However, reflector element 121 and director element 125 may attach directly to boom 129, resulting in electrical contact with boom 129 if boom 129 comprises conductive materials. In FIG. 1, link 151 is shown connected to the active segment of driven element 123 at connection point 152, and link 161 is shown connected to the ground segment of driven element 123 at connection point 162. Yagi antenna 120 could comprise any directional antenna system, such as a Yagi-Uda antenna.

Mounting plate 130 attaches to the outer non-conductive layer of parabolic antenna 110. However, in some examples, mounting plate 130 comprises base 115. Mounting plate 130 may comprise any material capable of mounting parabolic antenna 110 to a surface. For example, mounting plate 130 could comprise metal, plastic, rubber, wood, Velcro, double-sided tape, or some other material. However, while mounting plate 130 may be constructed of conductive materials such as metal, note that mounting plate 130 would then typically be electrically isolated from the inner conductive layer of parabolic antenna 110. Mounting plate 130 may be omitted in some examples.

Yagi antenna 120 is non-conductively connected to mounting plate 130 within the cavity of parabolic antenna 110. However, in examples where mounting plate 130 is omitted, yagi antenna 120 is non-conductively connected to base 115 of parabolic antenna 110 and located within the cavity of parabolic antenna 110. Reflector element 121 of yagi antenna 120 is located proximate to mounting plate 130 and base 115 of parabolic antenna 110. Director element 125 is located proximate to the vertex of parabolic antenna 110. Driven element 123 is located between reflector element 121 and director element 125. While yagi antenna 120 is shown in FIG. 1 as comprising only a single director element 125, in some examples, yagi antenna 120 comprises multiple director elements.

Communication link interface 140 is configured to attach a communication link to an external antenna (not shown). Communication link interface 140 is electrically coupled to driven element 123 and configured to receive electromagnetic energy from director element 125. Link 151 connects to core lead 141 of communication link interface 140 at connection point 142 and connects to an active segment of driven element 123 at connection point 152. Core lead 141 perforates parabolic antenna 110 and extends into the cavity of parabolic antenna 110. As shown in FIG. 1, communication interface 140 comprises an outer ground sheath which is electrically isolated from core lead 141 and provides a ground connection to a ground segment of driven element 123 over link 161 between connection points 145 and 162. However, in some examples, communication link interface 140 solely comprises active lead 141, and a ground connection to the ground segment of driven element 123 is provided by a separate connection, such as a common ground. Links 151 and 161 comprise a conductive material, such as metal.

Figure 2:
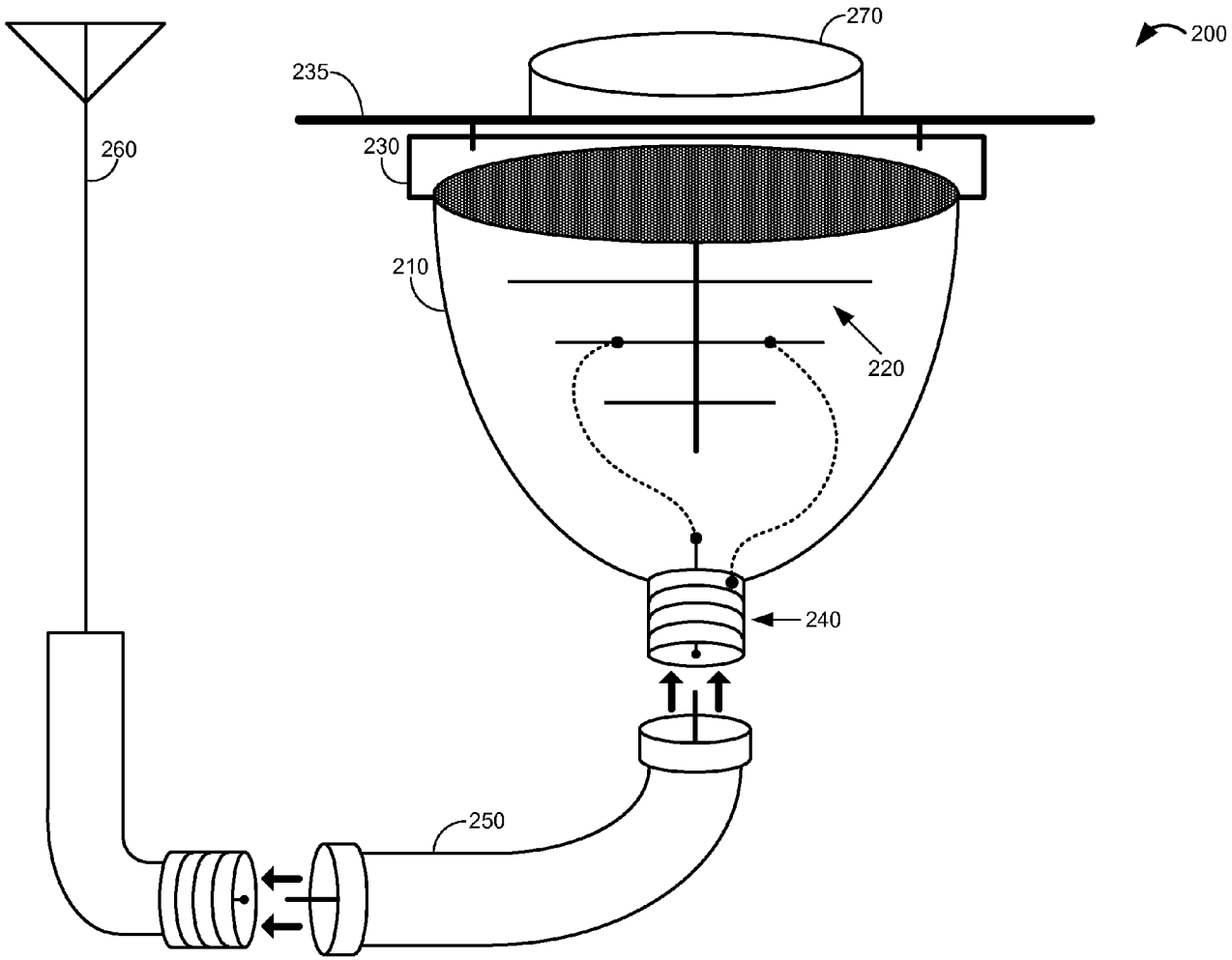
FIG. 2 is a schematic drawing of a vehicle antenna system.

FIG. 2 is a schematic drawing of vehicle antenna system 200. Vehicle antenna system 200 comprises parabolic antenna 210, yagi antenna 220, mounting plate 230, communication link interface 240, communication link 250, external antenna 260, and wireless communication device cradle 270.

Mounting plate 230 is configured to attach to a vehicle. Thus, as shown in FIG. 2, vehicle antenna system 200 is mounted to a vehicle mounting surface 235 via mounting plate 230. Vehicle mounting surface 235 could comprise any surface suitable for mounting vehicle antenna system 200, such as a dash board, center console, coin tray, glove box, cup holder, door panel, or some other surface within a vehicle. Mounting plate 230 may comprise any material capable of mounting vehicle antenna system 200 to vehicle mounting surface 235. For example, mounting plate 230 could comprise a plastic or metal bracket, rubber, wood, Velcro, double-sided tape, or some other material. In some examples, parabolic antenna 210 is mounted within a cavity of a vehicle's interior, such as mounted to the underside of the dash board within an empty cavity beneath the dash, so that parabolic antenna 210 is hidden from sight when installed.

Wireless communication device cradle 270 is located proximate to the base of parabolic antenna 210 so that wireless communication signals may be sent and received through parabolic antenna 210 by a communication interface of a wireless communication device. Wireless communication device cradle 270 could comprise any material or construction of materials designed to hold a wireless communication device in a fixed location proximate to the base of parabolic antenna 210. For example, wireless communication device cradle 270 could comprise a near field inductive coupling element, device holder, clip, bracket, holster, magnet, Velcro, double-sided tape, or any other material or construction capable of preventing a wireless communication device from sliding out of a fixed position when a vehicle is in motion.

Communication link 250 is configured to attach to communication link interface 240 and external antenna 260. Communication link 250 comprises a metallic link for use as the transport media. Communication link 250 may be a direct link or could include intermediate circuitry, components, systems, or devices. In some examples, communication link 250 comprises a coaxial cable. Thus, in these examples, communication link interface 240 would comprise a coaxial cable interface. In this case, a core lead of the coaxial cable interface is connected to an active segment of the driven element of yagi 220 and a shield lead of the coaxial cable interface is connected to a ground segment of the driven element.

Communication link 250 connects to external antenna 260. External antenna 260 is configured to attach to a vehicle. External antenna 260 could comprise a factory installed vehicle antenna or an aftermarket antenna system installed by a third party. External antenna 260 can provide either an active antenna connection (i.e., powered electronics) or a passive antenna connection (i.e., no active electronics). For example, external antenna 260 could comprise a roof mounted global positioning system (GPS) antenna, a personal communications service (PCS) band external antenna, such as a Code Division Multiple Access (CDMA) or Global System for Mobile communications (GSM) band antenna, or some other external antenna system.

Figure 3:
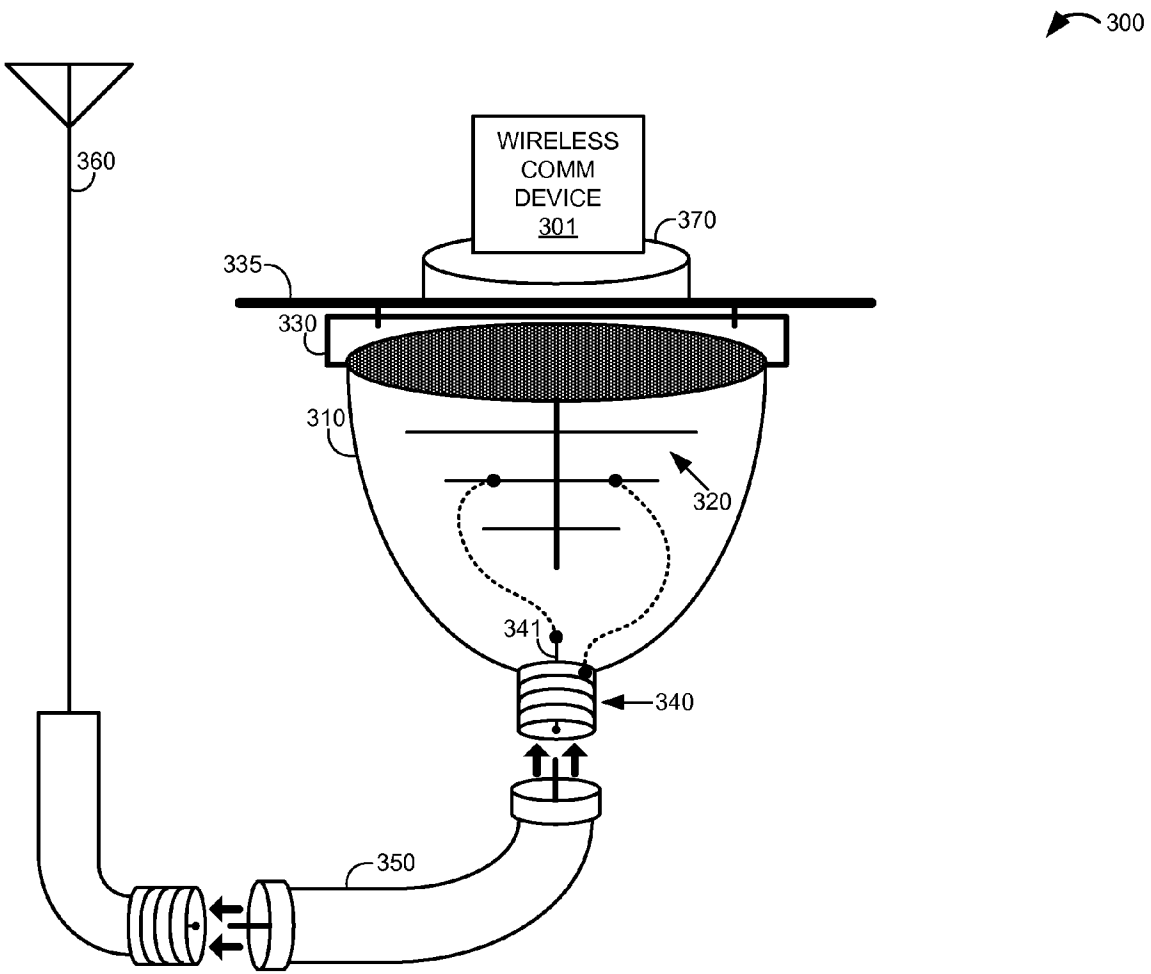
FIG. 3 is a schematic drawing of the vehicle antenna system in an exemplary embodiment.

FIG. 3 is a schematic drawing of vehicle antenna system 300 in an exemplary embodiment. Vehicle antenna system 300 comprises parabolic antenna 310, yagi antenna 320, mounting plate 330, communication link interface 340, communication link 350, external antenna 360, and wireless communication device cradle 370. Parabolic antenna 310 is mounted to a vehicle mounting surface 335 via mounting plate 330.

Wireless communication device 301 is configured to attach to wireless communication device cradle 370. In vehicle antenna system 300, wireless communication device cradle 370 comprises a near field inductive coupling element configured to inductively charge an internal power supply of wireless communication device 301. Thus, in this example, wireless communication device 301 comprises components configured to inductively or magnetically couple to the near field inductive coupling element of wireless communication device cradle 370. The advantages of the inductive coupling element of cradle 370 are at least twofold, in that not only does an internal battery of wireless communication device 301 receive a power charge through electromagnetic induction, but the magnetic coupling also serves to hold device 301 in place atop cradle 370 to prevent device 301 from sliding around a moving vehicle and to ensure device 301 is properly positioned for use with parabolic antenna 310.

Pin 341 of communication link interface 340 comprises a metallic lead extending through the outer surface of parabolic antenna 310 and into the interior cavity. Parabolic antenna 310 is sealed at the penetration point where pin 341 enters the cavity. Yagi antenna 320 is configured to focus electromagnetic energy on pin 341. The length of pin 341 may be adjusted to match a wavelength appropriate for vehicle antenna system 300. In other words, the distance of the pin 341 to the yagi antenna 320 may be designed to match a desired frequency.

Similarly, the length of the reflector, director, and driven elements of yagi antenna 320 may be adjusted to suit a particular wavelength application. For example, yagi antenna 320 may be tuned to operate in a frequency band licensed by the wireless communication service provider associated with wireless communication device 301 by adjusting the length of the elements attached to the boom. In addition, while yagi antenna 320 is shown with only a single director element for clarity, additional director elements may be added to increase the gain of yagi antenna 320. However, physical space considerations when mounting parabolic antenna 310 within a vehicle may dictate the yagi antenna 320 design constraints. Because multiple director elements necessarily increase the physical size of yagi antenna 320, a relatively larger parabolic antenna 310 is necessary to contain the larger yagi antenna 320. Therefore, in larger vehicles, four or more elements may be used in the yagi antenna 320 construction, but space limitations of a compact car may necessitate only the three element yagi antenna 320 depicted in FIG. 3, for example. Advantageously, the three element yagi antenna 320 in FIG. 3 could be constructed to have a physical size as small as three or four inches, thereby minimizing the amount of space required to install vehicle antenna system 300.

Figure 4:
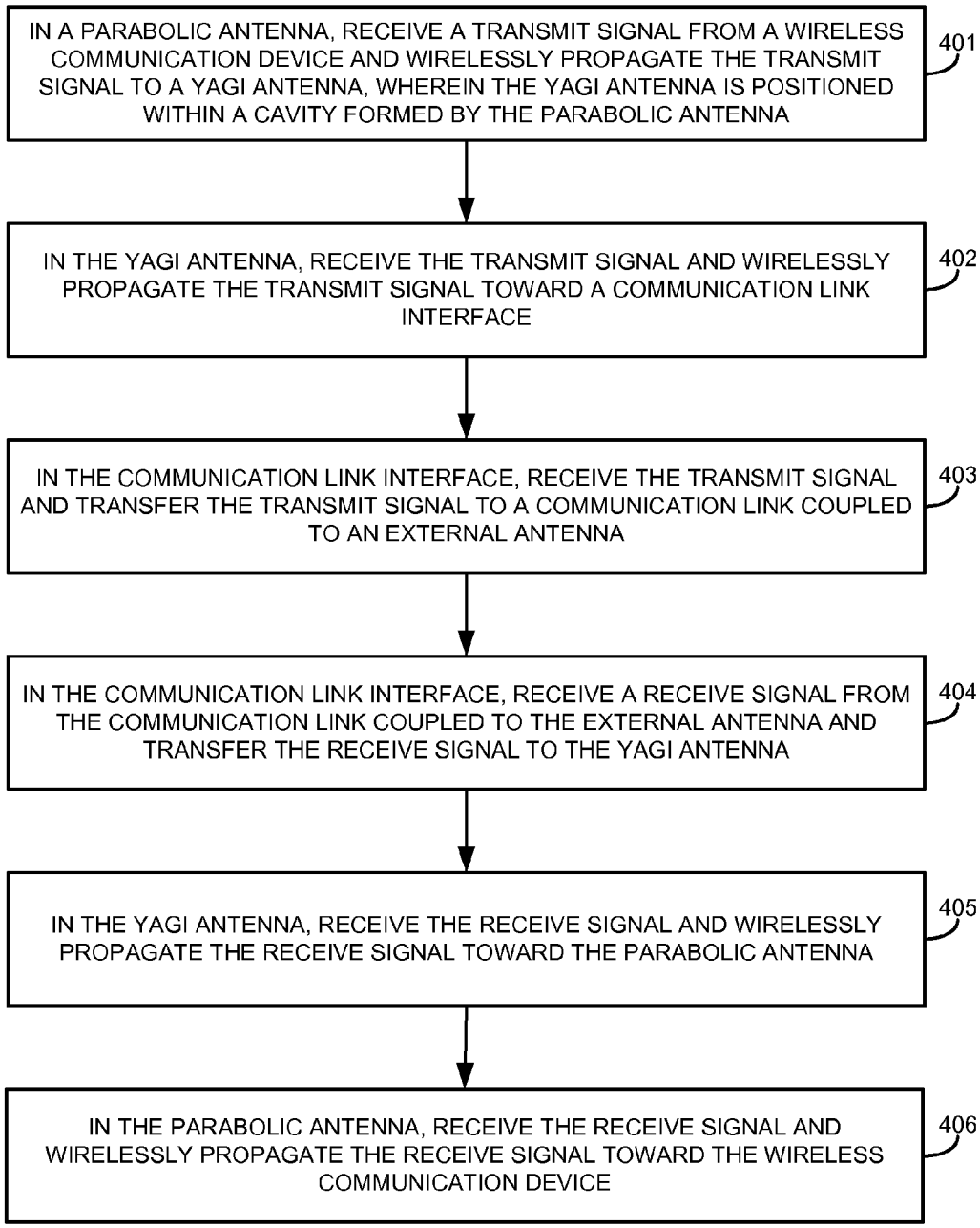
FIG. 4 is a flow diagram that illustrates an operation of the vehicle antenna system in an exemplary embodiment.

FIG. 4 is a flow diagram that illustrates an operation of vehicle antenna system 300 in an exemplary embodiment. The steps of the operation are indicated below parenthetically. In FIG. 4, parabolic antenna 310 receives a transmit signal from wireless communication device 301 (401). The transmit signal comprises an RF communication signal transmitted by a wireless communication interface of wireless communication device 301. Parabolic antenna 310 then wirelessly propagates the transmit signal to yagi antenna 320 (401). As shown in FIG. 3, yagi antenna 320 is positioned within a cavity formed by the parabolic antenna 310 (401).

Yagi antenna 320 receives the transmit signal and wirelessly propagates the transmit signal toward communication link interface 340 (402). Communication link interface 340 receives the transmit signal and transfers the transmit signal to communication link 350 coupled to external antenna 360 (403). In some examples, communication link interface 340 transfers the transmit signal to communication link 350 by transferring the transmit signal to a coaxial cable coupled to external antenna 360. In this manner, the transmit signal originating from wireless communication device 301 may then be wirelessly propagated by external antenna 360.

For receiving signals intended for wireless communication device 301, communication link interface 340 receives a receive signal from communication link 350 coupled to external antenna 360 (404). Communication link interface 340 transfers the receive signal to yagi antenna 320 (404). In some examples, transferring the receive signal from communication link interface 340 to yagi antenna 320 comprises transferring the receive signal from a core lead of a coaxial cable interface to a driven element of yagi antenna 320.

Yagi antenna 320 receives the receive signal and wirelessly propagates the receive signal toward parabolic antenna 310 (405). Parabolic antenna 310 then receives the receive signal and wirelessly propagates the receive signal toward wireless communication device 301 (406).

Advantageously, vehicle antenna system 300 and the operation of FIG. 4 enables wireless communication device 301 operated within a vehicle to utilize the vehicle's external antenna 360. External antenna 360 provides an improved location for signal reception and transmission, resulting in a better line of sight to serving base stations and increased shielding from multipath interference. Additionally, since wireless communication device 301 requires less transmit power when coupled to external antenna 360, the battery power of wireless communication device 301 is conserved. When wireless communication device 301 is coupled to vehicle antenna system 300, a user will experience increased data speeds, clearer voice calls, reduced dropped calls, and better RF signal strength, resulting in increased overall satisfaction for the user.

Figure 5:
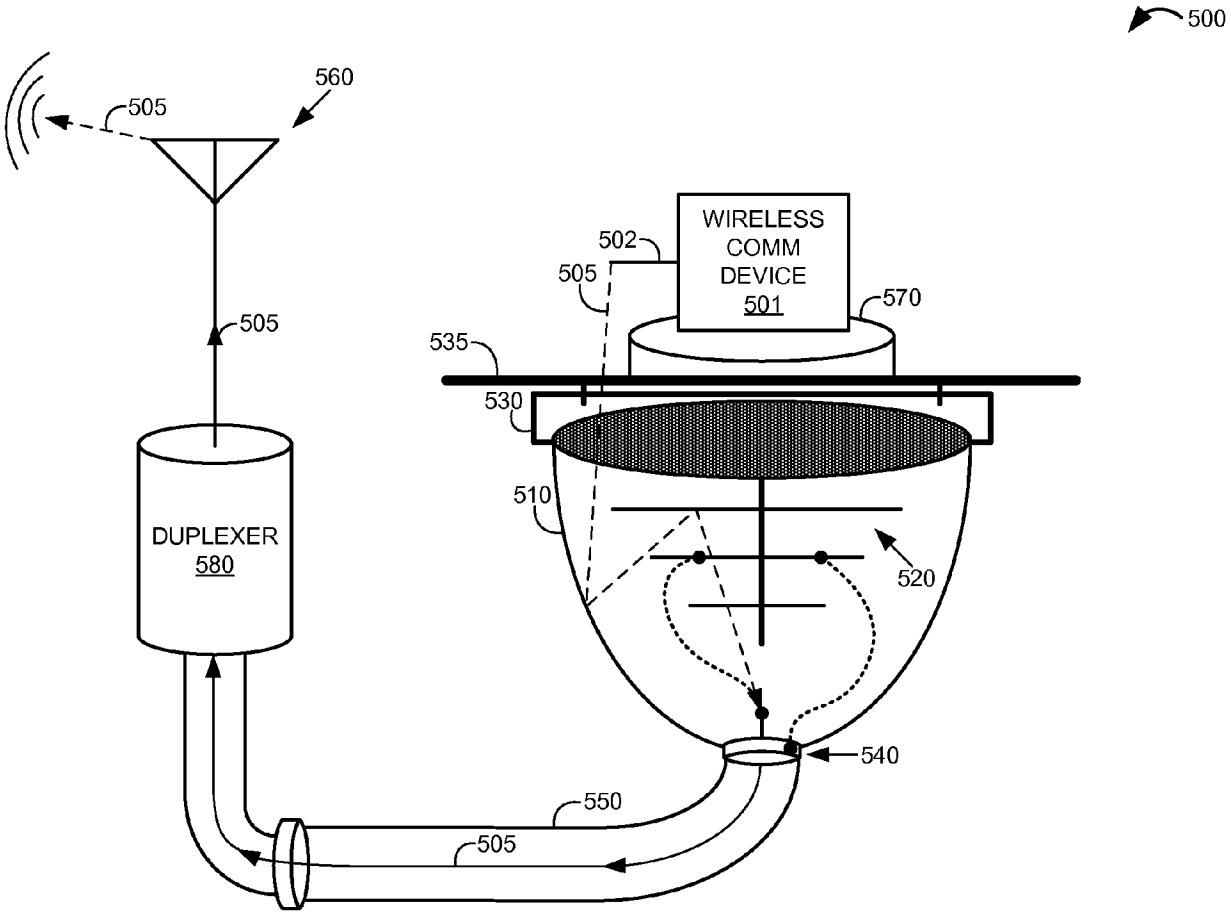
FIG. 5 is a schematic drawing of a wireless communication device transmitting a signal over a vehicle antenna system in an exemplary embodiment.

FIG. 5 is a schematic drawing of wireless communication device 501 transmitting a signal 505 over vehicle antenna system 500 in an exemplary embodiment. Wireless communication device 501 comprises wireless communication interface 502. Wireless communication interface 502 comprises RF communication circuitry and an antenna. Vehicle antenna system 500 comprises parabolic antenna 510, yagi antenna 520, mounting plate 530, communication link interface 540, communication link 550, external antenna 560, wireless communication device cradle 570, and duplexer 580. Parabolic antenna 510 is mounted to a vehicle mounting surface 535 by mounting plate 530. Duplexer 580 is configured to enable both transmission and reception of signals over a single channel. However, only signal transmission by wireless communication device 501 is shown in FIG. 5 for clarity.

The signal transmitted by wireless communication device 501 in FIG. 5 is indicated by reference number 505. The directional arrows along the signal path show the directional flow of transmit signal 505 through vehicle antenna system 500. Wireless communication device 501 is positioned on wireless communication device cradle 570 so that the signal 505 transmitted by wireless communication interface 502 is wirelessly propagated through the base of parabolic antenna 510. When transmit signal 505 enters the cavity of parabolic antenna 510, the signal 505 is reflected off the inner conductive layer of parabolic antenna 510 toward yagi antenna 520. When the signal 505 reaches yagi antenna 520, signal 505 is reflected off of yagi antenna 520 and wirelessly propagated toward communication link interface 540.

Communication link interface 540 then transfers the transmit signal 505 along communication link 550. Communication link 550 carries the signal 505 to duplexer 580. Signal 505 is then routed through circuitry within duplexer 580 which isolates the transmit signal 505 and prevents interference from any incoming receive signals (not shown in FIG. 5). Signal 505 is then output from duplexer 580 and continues to external antenna 560 that is attached to duplexer 580. Finally, external antenna 560 wirelessly propagates the transmit signal 505 to a serving base station of wireless communication device 501.

Figure 6:
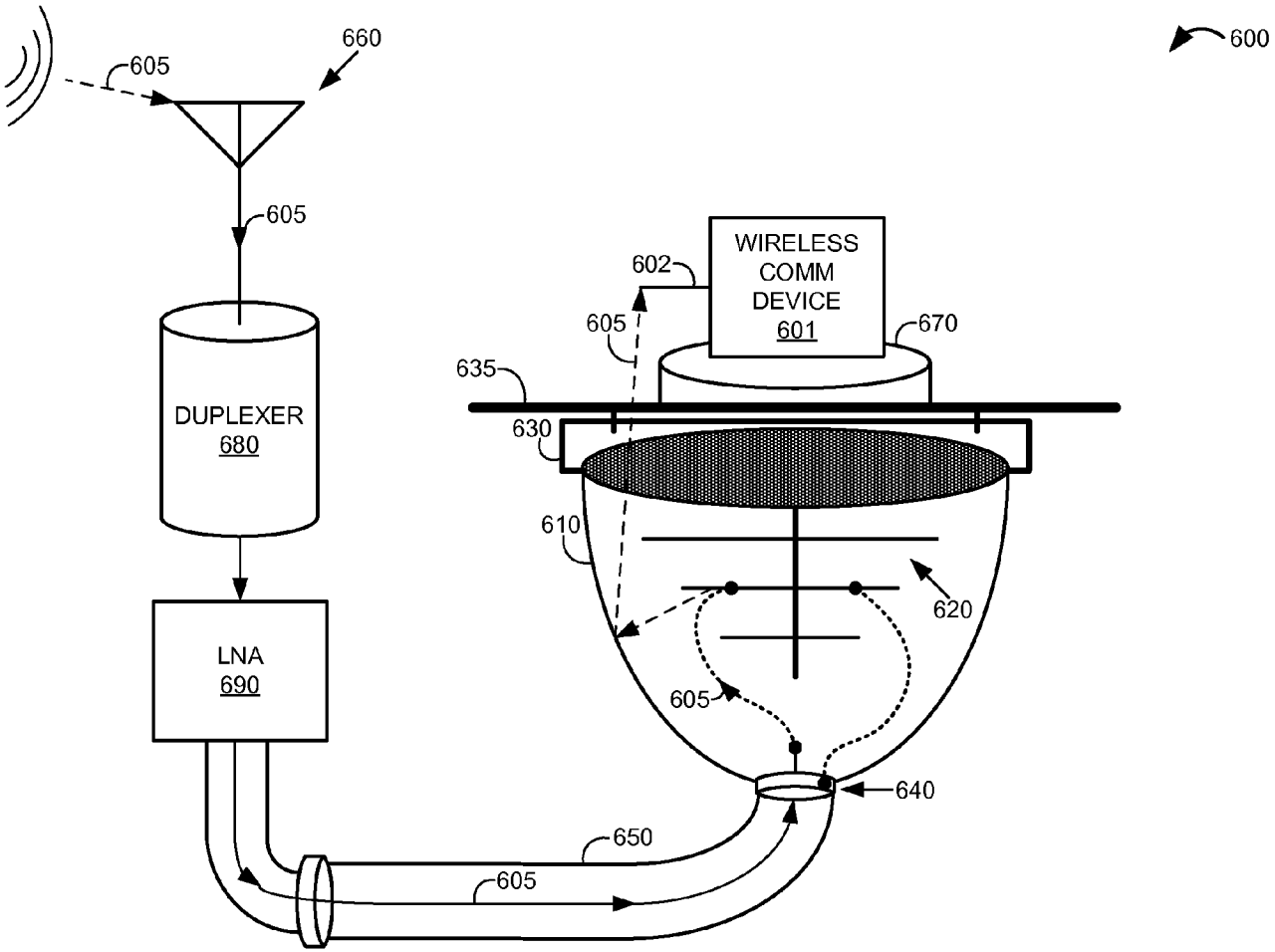
FIG. 6 is a schematic drawing of a wireless communication device receiving a signal over a vehicle antenna system in an exemplary embodiment.

FIG. 6 is a schematic drawing of wireless communication device 601 receiving a signal 605 over vehicle antenna system 600 in an exemplary embodiment. Wireless communication device 601 comprises wireless communication interface 602. Vehicle antenna system 600 comprises parabolic antenna 610, yagi antenna 620, mounting plate 630, communication link interface 640, communication link 650, external antenna 660, wireless communication device cradle 670, duplexer 680, and low noise amplifier (LNA) 690. Parabolic antenna 610 is mounted to a vehicle mounting surface 635 by mounting plate 630. LNA 690 is configured to amplify signals received by external antenna 660. Duplexer 680 is configured to enable both transmission and reception of signals over a single channel. However, only a signal intended for wireless communication device 601 received by external antenna 660 is shown in FIG. 6 for clarity.

The directional arrows along the signal path show the directional flow of receive signal 605 through vehicle antenna system 600. External antenna 660 wirelessly receives the receive signal 605 from a serving base station of wireless communication device 601. Signal 605 is then transferred to duplexer 680 where signal 605 is routed through circuitry within duplexer 680 which isolates the receive signal 605 and prevents interference from any outgoing transmit signals transmitted by wireless communication device 601 (not shown in FIG. 6). Signal 605 is then output from duplexer 680 and is transferred to LNA 690 for signal amplification. The amplified receive signal 605 is then output from LNA 690 and continues to communication link 650 that is attached to communication link interface 640.

When the receive signal 605 reaches communication link interface 640, communication link interface 640 transfers the signal 605 from a core lead of communication link interface 640 to an active segment of the driven element of yagi antenna 620. Yagi antenna 620 receives the signal 605 from communication link interface 640 and wirelessly propagates the receive signal toward the parabolic antenna 610. The receive signal 605 is then reflected off the inner conductive layer of parabolic antenna 610 and directed toward the wireless communication interface 602 of device 601. Wireless communication device 601 is positioned on wireless communication device cradle 670 so that the receive signal 605 may be received by wireless communication interface 602. The receive signal 605 thus exits the cavity of parabolic antenna 610 through the base of parabolic antenna 610 and wirelessly propagates to the antenna of wireless communication interface 602. The RF communication circuitry of wireless communication interface 602 then processes the receive signal and transfers the data to a processing system of wireless communication device 601.

Figure 7:
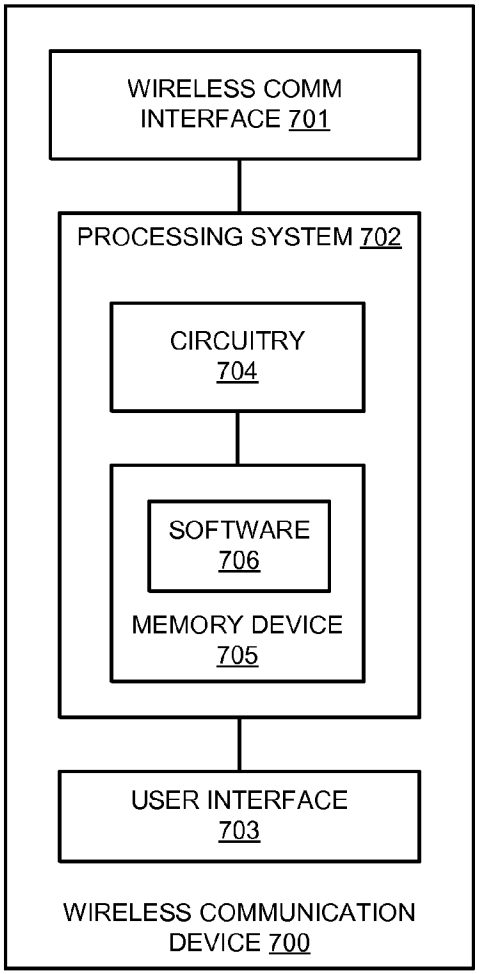
FIG. 7 is a block diagram that illustrates a wireless communication device.

FIG. 7 is a block diagram that illustrates wireless communication device 700. Wireless communication device 700 provides an example of wireless communication devices 301, 501, and 601, although devices 301, 501, and 601 could use alternative configurations. Wireless communication device 700 comprises wireless communication interface 701, processing system 702, and user interface 703. Processing system 702 is linked to wireless communication interface 701 and user interface 703. Processing system 702 includes processing circuitry 704 and memory device 705 that stores operating software 706. Wireless communication device 700 may include other well-known components such as a battery and enclosure that are not shown for clarity. Wireless communication device 700 may comprise a telephone, computer, e-book, mobile Internet appliance, media player, game console, wireless network interface card, or some other wireless communication apparatus—including combinations thereof.

Wireless communication interface 701 comprises RF communication circuitry and an antenna. The RF communication circuitry typically includes an amplifier, filter, RF modulator, and signal processing circuitry. Wireless communication interface 701 may also include a memory device, software, processing circuitry, or some other communication device. Wireless communication interface 701 may use various protocols, such as Code Division Multiple Access (CDMA) 1xRTT, Global System for Mobile communications (GSM), Universal Mobile Telecommunications System (UMTS), High-Speed Packet Access (HSPA), Evolution-Data Optimized (EV-DO), EV-DO rev. A, Third Generation Partnership Project Long Term Evolution (3GPP LTE), Worldwide Interoperability for Microwave Access (WiMAX), IEEE 802.11 protocols (Wi-Fi), Internet, telephony, or some other wireless communication format—including combinations thereof.

User interface 703 comprises components that interact with a user to receive user inputs and to present media and/or information. User interface 703 may include a speaker, microphone, buttons, lights, display screen, touch screen, touch pad, scroll wheel, communication port, or some other user input/output apparatus—including combinations thereof. User interface 703 may omitted in some examples.

Processing circuitry 704 comprises microprocessor and other circuitry that retrieves and executes operating software 706 from memory device 705. Memory device 705 comprises a disk drive, flash drive, data storage circuitry, or some other memory apparatus. Processing circuitry 704 is typically mounted on a circuit board that may also hold memory device 705 and portions of communication interface 701 and user interface 703. Operating software 706 comprises computer programs, firmware, or some other form of machine-readable processing instructions. Operating software 706 may include an operating system, utilities, drivers, network interfaces, applications, or some other type of software. When executed by processing circuitry 704, operating software 706 directs processing system 702 to operate wireless communication device 700 as described herein. In particular, operating software 706 directs processing system 702 to direct wireless communication interface 701 transmit a transmit signal to a parabolic antenna and to receive a receive signal from a parabolic antenna.

Additionally, in some examples, wireless communication device 700 may also be configured to attach to a wireless communication device cradle. Also, in some examples, wireless communication device 700 may additionally comprise components and circuitry configured to inductively couple to a near field inductive coupling element.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. As a result, the invention is not limited to the specific embodiments described above, but only by the following claims and their equivalents.

What is claimed is:

1. An antenna system comprising:

a mounting plate;

a parabolic antenna forming a cavity and comprising a vertex and a base, wherein the base is non-conductively connected to the mounting plate;

a yagi antenna non-conductively connected to the mounting plate within the cavity of the parabolic antenna, wherein the yagi antenna comprises a reflector element proximate to the mounting plate, a driven element, and a director element proximate to the vertex of the parabolic antenna; and a communication link interface configured to attach a communication link to an external antenna, the communication link interface electrically coupled to the driven element and configured to receive electromagnetic energy from the director element.

2. The system of claim 1 wherein the mounting plate is configured to attach to a vehicle.

3. The system of claim 1 wherein the parabolic antenna is perforated.

4. The system of claim 1 wherein the parabolic antenna comprises an elliptical paraboloid.

5. The system of claim 1 wherein the communication link interface comprises a coaxial cable interface.

6. The system of claim 5 wherein a core lead of the coaxial cable interface is connected to an active segment of the driven element and a shield lead of the coaxial cable interface is connected to a ground segment of the driven element.

7. The system of claim 1 further comprising a near field inductive coupling element.

8. The system of claim 7 wherein the near field inductive coupling element is configured to inductively charge an internal power supply of the wireless communication device.

9. A vehicle antenna system comprising:

a mounting plate configured to attach to a vehicle;

an external antenna configured to attach to the vehicle;

a parabolic antenna forming a cavity and comprising a vertex and a base, wherein the base is non-conductively connected to the mounting plate;

a yagi antenna non-conductively connected to the mounting plate within the cavity of the parabolic antenna, wherein the yagi antenna comprises a reflector element proximate to the mounting plate, a driven element, and a director element proximate to the vertex of the parabolic antenna;

a communication link interface configured to attach a communication link to the external antenna, the communication link interface electrically coupled to the driven element and configured to receive electromagnetic energy from the director element;

the communication link configured to attach to the communication link interface and the external antenna; and a wireless communication device cradle.

10. The system of claim 9 wherein the parabolic antenna is perforated.

11. The system of claim 9 wherein the parabolic antenna comprises an elliptical paraboloid.

12. The system of claim 9 wherein the communication link interface comprises a coaxial cable interface.

13. The system of claim 12 wherein a core lead of the coaxial cable interface is connected to an active segment of the driven element and a shield lead of the coaxial cable interface is connected to a ground segment of the driven element.

14. The system of claim 9 wherein the wireless communication device cradle comprises a near field inductive coupling element.

15. The system of claim 14 wherein the near field inductive coupling element is configured to inductively charge an internal power supply of the wireless communication device.

16. A method of operating an antenna system, the method comprising:

in a parabolic antenna, receiving a transmit signal from a wireless communication device and wirelessly propagating the transmit signal to a yagi antenna, wherein the yagi antenna is positioned within a cavity formed by the parabolic antenna;

in the yagi antenna, receiving the transmit signal and wirelessly propagating the transmit signal toward a communication link interface;

in the communication link interface, receiving the transmit signal and transferring the transmit signal to a communication link coupled to an external antenna;

in the communication link interface, receiving a receive signal from the communication link coupled to the external antenna and transferring the receive signal to the yagi antenna;

in the yagi antenna, receiving the receive signal and wirelessly propagating the receive signal toward the parabolic antenna; and in the parabolic antenna, receiving the receive signal and wirelessly propagating the receive signal toward the wireless communication device.

17. The method of claim 16 wherein transferring the receive signal from the communication link interface to the yagi antenna comprises transferring the receive signal from a core lead of a coaxial cable interface to a driven element of the yagi antenna.

18. The method of claim 16 wherein transferring the transmit signal to the communication link coupled to the external antenna comprises transferring the transmit signal to a coaxial cable coupled to the external antenna.

19. The method of claim 16 wherein the parabolic antenna comprises an elliptical paraboloid.

20. The method of claim 16 wherein the antenna system is mounted to a vehicle having the external antenna.

* * * * *